United States Patent [19]

Nelson

[11] Patent Number: 4,895,545

[45] Date of Patent: Jan. 23, 1990

[54] BALLOON CUP HOLDER AND STICK

[76] Inventor: David C. Nelson, 1585 S. Cleveland-Massillon Rd., Copley, Ohio 44321

[21] Appl. No.: 211,911

[22] Filed: Jun. 27, 1988

[51] Int. Cl.[4] ..... A63H 3/06

[52] U.S. Cl. ..... 446/220; 446/222; 206/315.1

[58] Field of Search ..... 446/220, 221, 222, 223, 446/224; 24/30 R, 30.5; 206/315.1

[56] References Cited

U.S. PATENT DOCUMENTS

| | | | |
|---|---|---|---|
| 2,664,667 | 1/1954 | Burroughs | 446/222 |
| 2,840,948 | 7/1958 | Stickley | 446/223 |
| 3,267,604 | 8/1966 | Goldsmith | 446/222 |
| 4,145,838 | 3/1979 | Mason | 446/220 X |
| 4,589,854 | 5/1986 | Smith | 446/223 |
| 4,661,081 | 4/1987 | Basseches | 446/222 X |
| 4,715,841 | 12/1987 | Nelson et al. | 446/222 |

*Primary Examiner*—Danton D. DeMille
*Assistant Examiner*—Sam Rimell
*Attorney, Agent, or Firm*—Renner, Kenner, Greive, Bobak, Taylor & Weber

[57] ABSTRACT

An integral balloon cup holder and stick is provided in which the cup has a longitudinal slit passing through the sidewall thereof from an open end of the cup to a closed end thereof which is attached to a shaft. The slot terminates at the stick. The cup has a neck and shoulder portion with a bottom of the neck being angled to direct a balloon neck outwardly through the slot for secured engagement about the neck prior to reinsertion of the balloon neck through the slot for maintenance within the cup and below a balloon nested therein.

11 Claims, 2 Drawing Sheets

BALLOON CUP HOLDER AND STICK

TECHNICAL FIELD

The invention herein resides in the art of novelty devices and, more particularly, to the combination of a balloon stick and cup holder which is uniquely adapted to attractively receive and secure small balloons having a diameter less than 7 inches. Specifically, the invention is adapted for accommodating such balloons which are manufactured of latex, "Mylar" or other heavy films.

BACKGROUND ART

Every year a large volume of inflatable toy balloons are sold or given away as novelty items. Such balloons are of two general types, those made of latex, and those made of non-elastomeric polymer film, usually polyethylene terphthalate ("Mylar"). Latex balloons are stretchable, typically having a short neck surrounding the inflation opening, and may be sold either collapsed or inflated. When sold in inflated form, they may be tied to a stick; usually they are tied directly to a balloon holder, which is then secured to a stick. "Mylar" balloons are non-stretchable, typically are metallized to give a silvery appearance, have a long neck typically about four inches (10 cm) long, and are usually distributed in inflated form secured to a stick by means of a balloon holder.

Various types of balloon holders have been proposed and known in the prior art for securing such "Mylar" balloons. The present state of the prior art is as shown in applicant's prior U.S. Pat. No. 4,715,841 which teaches a balloon holder quite satisfactory for larger "Mylar" balloons having a diameter exceeding 7 inches. This patent teaches a cup maintained on a hollow stem The cup is uniquely adapted to receive the "Mylar" balloon, while the hollow stem is adapted to be inserted into a balloon stick. The neck of the balloon is pulled down through a slit which passes axially through the cup and stem and is tucked into the stem and maintained therein by friction fit when the stem is inserted into a hollow balloon stick. While this structure is satisfactory for large "Mylar" balloons, which can accommodate a large cup and a correspondingly large hollow stem, it is known that thick film balloons as well as latex balloons often have necks with material too thick to accommodate receipt within the hollow stem. This problem worsens with extremely small balloons such as the now-popular "lollipop" and "micro" balloons. With such balloons, both the holder and the stick must be as small as possible so as not to overpower the balloon in appearance. With a small cup and stick, there simply is insufficient room in any conceivable hollow stem for receiving the material of the balloon neck while accommodating a stick in friction fit.

In the prior art of U.S. Pat. No. 4,715,841, the stem of the balloon cup must be of sufficient size to receive the material of the balloon neck. This in turn dictates the size of the balloon stick which must receive the stem. For "micro" and "lollipop" balloons having respective diameters of 3" and 2", the requisite balloon stick is simply too large to be aesthetically pleasing. Even for larger balloons, material costs dictate that the balloon stick be of minimal diameter. By eliminating the need for receiving the balloon neck by the stem and/or stick, the diameter of the stick can be reduced and standardized for all balloon sizes, greatly reducing material costs. Further, by eliminating the complexity of the stem of the balloon cup such that it does not need to receive the balloon neck, a reduction in both mold time and mold complexity can be obtained. Finally, by eliminating the need to receive the balloon neck at the interface of the stick and stem, the technique for assembling the balloon to the cup and stick can be greatly simplified.

As stated above, to be aesthetically pleasing, the size of the balloon cup must not overpower the size of the balloon itself. It is generally accepted that the mouth of the balloon cup should be less than 25% of the diameter of the balloon itself. This, however, creates a new problem related to the Consumer Safety Product Regulations pertaining to small parts. Current regulations require that a small part, such as a balloon holder, must be either at least $1\frac{1}{4}$" in diameter or at least $2\frac{1}{2}$" in length to pass the non-choke test for child safety. Following prior art teachings, child safety could thus be compromised for aesthetics in assemblies devised for "micro" and "lollipop" balloons.

The prior art has suggested that a solid stick may be used with a molded hinged clip at the end thereof. While, this prior art teaching satisfies the requirements for child safety, it does not support the balloon symmetrically upon the stick and does not provide for firm, rigid support in any manner. Further, this type of prior art stick and clip exposes the material of the balloon neck, allowing the same to detract from the innate beauty of the balloon itself.

DISCLOSURE OF INVENTION

In light of the foregoing, it is a first aspect of the invention to provide a balloon cup adapted for proportionally accommodating "lollipop" and "micro" balloons.

Yet another aspect of the invention is the provision of a balloon cup with an integral stick adapted for receiving "lollipop" and "micro" balloons while satisfying requirements for child safety.

Still a further aspect of the invention is the provision of a balloon cup with integral stick in which the cup is slit from a top open end to a bottom closed end.

Yet an additional aspect of the invention is the provision of a balloon cup and integral hollow stem, the cup being slit only from an open end to a closed bottom end.

Yet a further aspect of the invention is the provision of a balloon cup adapted for receiving and nesting "Mylar" balloons with the end of the balloon neck being concealed within the cup itself.

The foregoing and other aspects of the invention which will become apparent as the detailed description proceeds are achieved by a balloon holder, comprising: a shaft; and a cup maintained at a first end of said shaft, said cup having a slot therein passing through a sidewall of said cup from an open first end of said cup to a closed second end thereof.

Still further aspects of the invention are obtained by a balloon holder, comprising: a substantially conical cup, open at a first wider end thereof and closed at a neck at a second narrower end thereof; a shaft connected to said neck; and a slot extending from said first open end of said cup to said neck and terminating short of said shaft.

BRIEF DESCRIPTION OF DRAWINGS

For a complete understanding of the objects, techniques and structure of the invention, reference should be had to the following detailed description and accompanying drawings wherein.

BEST MODE FOR CARRYING OUT THE INVENTION

Figure 3:
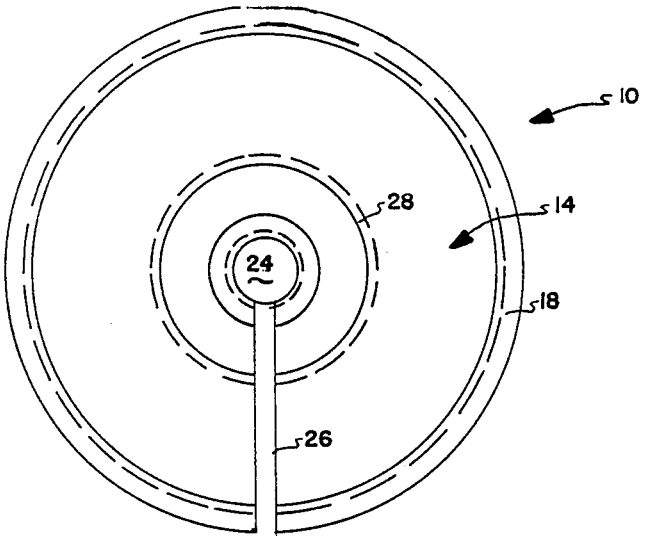
FIG. 3 is a top plan view of the balloon cup holder and stick of FIG. 1.
Figure 1:
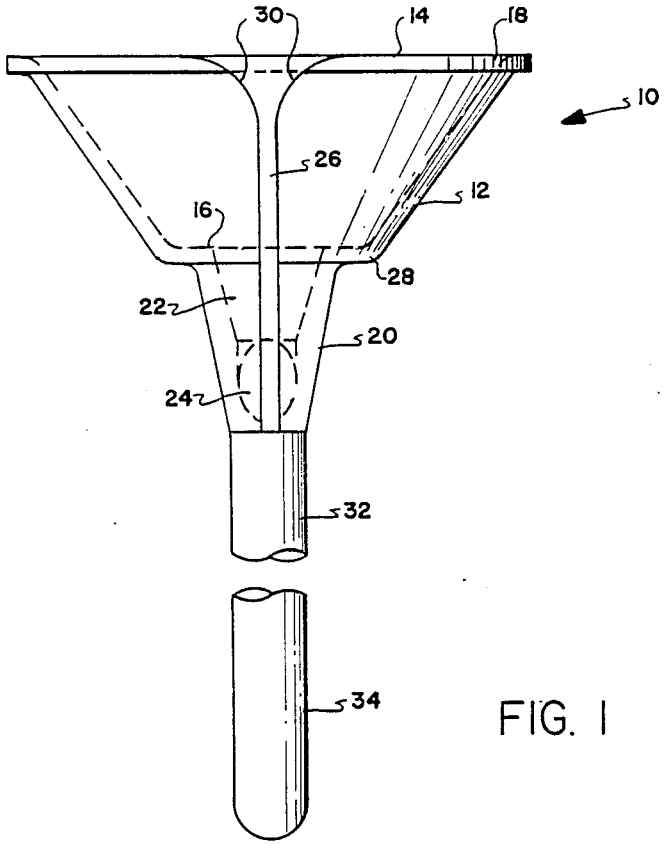
FIG. 1 is a front perspective view of a balloon cup holder and stick according to the invention.
Figure 2:
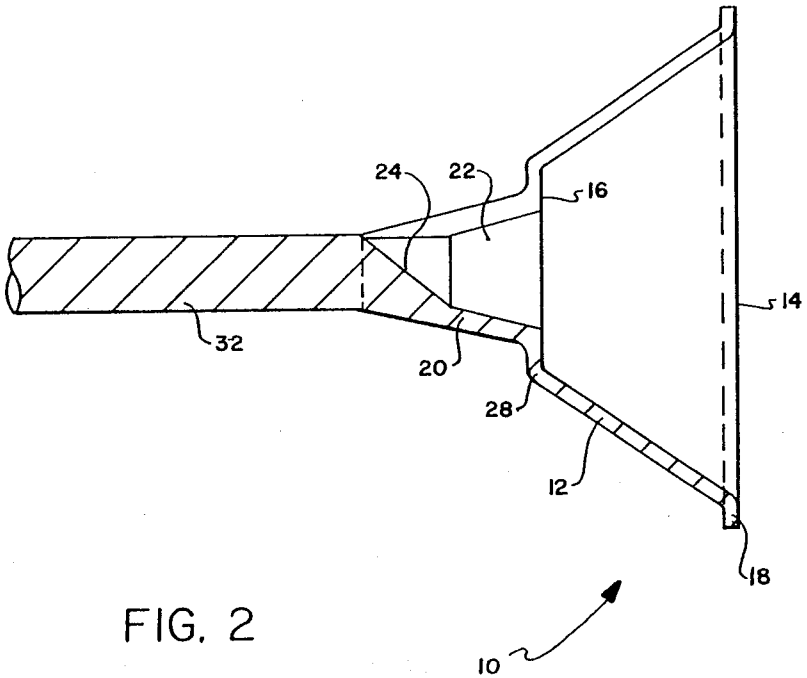
FIG. 2 is a partial sectional view of the balloon cup holder and stick of FIG. 1.

With reference now to the drawings and more particularly FIGS. 1–3, it can been seen that a balloon holder according to the invention is designated generally by the numeral 10. The balloon holder 10 comprises a cup 12 having a wider mouth 14 at one end thereof and a narrower base 16 at the other. Accordingly, the cup 12 has a substantially trapezoidal cross-section of frusto conical nature. A flange or lip 18 encircles the opening of the mouth 14 while a neck 20 extends downwardly from the opposite end of the cup 12. As shown, a shoulder 28 is interposed between the neck 20 and the conical sidewall of the cup 12, the shoulder 28 being of a larger diameter than the neck 20, but a smaller diameter than any cross-sectional portion of the cup 12.

The neck 20 includes a hollow cylindrical portion 22 which communicates with the interior of the cup 12. The bottom or base 24 of the hollow cylindrical portion 22 is angled or biased on the order of 30°–60°, and preferably 45° with respect to a longitudinal axis of the cup 12.

As an important feature of the invention, a slot 26 passes through the sidewall of the cup 12 and the corresponding sidewall of the neck 20 in substantial alignment with the central axis thereof. The slot 26 passes from the flange or lip 18 to the bottom most portion of the base or bottom 24.

As shown, the slot 26 is rounded at the top edge portions 30 where the slot 26 rolls into the flange 18. As will become apparent hereinafter, the rounded top portion of the slot 26 obviates any sharp corners which might have a tendency to tear or puncture the film of any balloon received within the balloon holder 10. In like manner, the base or bottom 24 is biased as discussed above to prevent such tearing while also serving to direct the neck of the balloon outwardly through the slot 26 in a manner to be discussed hereinafter.

Figure 4:
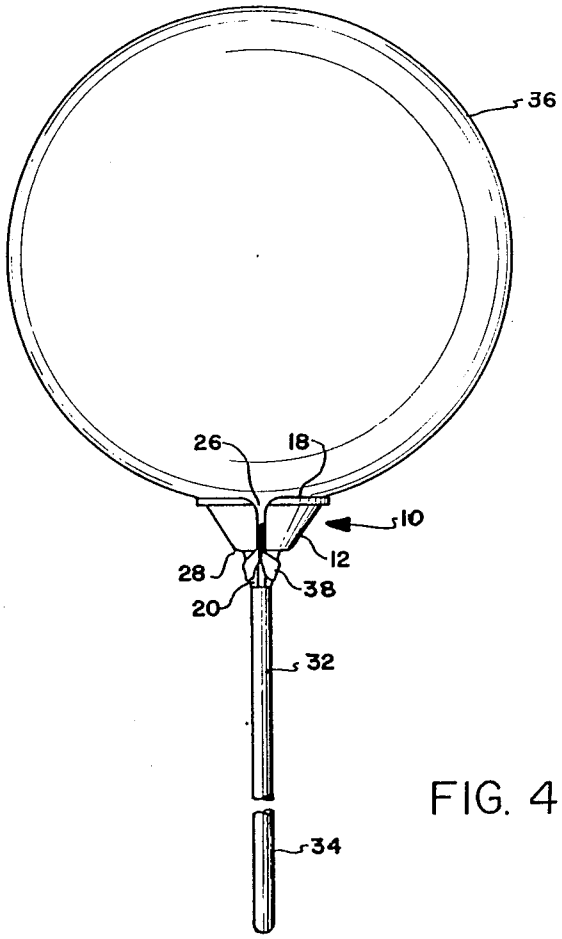
FIG. 4 is a front perspective view of a balloon cup holder and stick according to the invention employed in the use of receiving a balloon.

As further shown in FIG. 1, 2 and 4, the cup 12 may include as a molded integral part thereof a top stick portion 32. It will be appreciated that the top stick portion 32 and a bottom stick portion 34 may constitute one integral continuous piece, which itself is integral with the cup 12, the same being molded of plastic or other suitable material. In such a situation, the stick 34 would be of a solid nature and would be of small diameter and length, on the order of 4″–10″, to accommodate the "lollipop" or "micro" balloons. The concept of the invention may, however, be expanded to adapt for implementation with larger "Mylar" balloons, in which case the top stick portion 32 would constitute a stem, also solid in nature, having a draft the exterior thereof having a draft for purposes of being received by a hollow balloon stick in friction fit. As shown in the drawing, the portion 32 would thus constitute a solid stem while the portion 34 would be a standard tubular balloon stick.

With reference now to FIG. 4, the employment of the balloon holder 10 with a "Mylar" balloon 36 may be seen. The "Mylar" balloon 36 is appropriately inflated in standard fashion. The neck of the balloon 38 is then pulled through the slot 26 to exit the bottom thereof, causing the balloon 36 to nest within the cup 12. As discussed above, the biasing of the bottom portion 24, along with the rounded edges 30 of the slot 26, accommodates such nesting, while directing the neck material 38 from the bottom of the slot 26, all while preventing the film of the balloon from being torn or punctured. With the neck 38 in hand, and exiting the bottom of the slot 26, the neck 38 of the balloon 36 may then be wrapped around the neck 20 of the balloon holder 10 to secure the balloon 36 in a tight nesting relation with the cup 12. The end of the neck 38 is then brought back through the slot 26 and tucked under the balloon 36 within the cup 12. Accordingly, the neck 38 forms a "necktie" of good appearance upon the neck 20 of the holder 10, the same being maintained beneath the shoulder 28.

It will be understood that an integral cup and stick combination made in accordance with the instant invention will be of rather small size. As mentioned above, the total length of the sticks 32,34 would be 4″–10″. The diameter of the stick would be on the order of 0.10″–0.18″, and most preferably 0.13″. The diameter of the mouth 14 of the cup 12 would most desirably be less than 1.0″, and most desirably 0.875″, measured from the extremities of the flange 18. The depth of the cup, measured from the top surface of the flange 18 to the corner of the shoulder 28, is on the order of 0.25″–0.50″, and most preferably 0.3″. A balloon holder 10 manufactured according to the foregoing dimensions is found to be very unobtrusive with respect to extremely small balloons such as the "lollipop" and "micro" balloons which are now popular while the unitary construction of the cup and stick satisfy the requirements of child safety. The neck of the balloon is easily concealed while also providing a means for tightly and securely nesting the balloon within the cup itself. The cup holder may be employed with an integral solid stick, or a shorter solid stem which is adapted for receipt by a standard balloon stick, this latter design being more suited for larger "Mylar" balloons. Of course, the concept presented above may be employed for unitary molding of cups and sticks of any of numerous sizes if so desired.

Thus it can be seen that the objects of the invention have been satisfied by the structure presented hereinabove. While in accordance with the patent statutes, only the best mode and preferred embodiment of the invention has been presented and described in detail, it is to be understood that the invention is not limited thereto or thereby. Accordingly, for an appreciation of the true scope and breadth of the invention, reference should be had to the following claims.

What is claimed is:

1. A balloon holder, comprising:

a shaft;

a cup maintained at a first end of said shaft, said cup having a slot therein passing through a sidewall of said cup from an open first end of said cup to an apertured second end thereof; and a neck located below said second end of said cup, said neck having a bottom surface which is oblique to a central axis of said shaft, said slot terminating at a point on said bottom surface which is furthest from said open first end of said cup.

2. The balloon holder according to claim 1 wherein said cup is substantially conical.

3. The balloon holder according to claim 1 wherein said shaft is integral with said cup.

4. The balloon holder according to claim 3 wherein said shaft is adapted to be received by a stick.

5. The balloon holder according to claim 4 wherein said shaft has a draft for being received by said stick in a friction fit.

6. The balloon holder according to claim 3 wherein said shaft is solid.

7. A balloon holder, comprising:

a substantially conical cup, open at a first wider end thereof and apertured at a second narrower end thereof; a neck located below said aperture a shaft connected to said neck;

a slot extending from said first open end of said cup to said neck and terminating short of said shaft; and wherein said neck has a bottom surface oblique with respect to a central axis of said shaft, said slot terminating at a point on said bottom surface furthest from said first open end,

8. The balloon holder according to claim 7 wherein said shaft and cup are integral with each other, said shaft being solid.

9. The balloon holder according to claim 8 wherein said shaft has a draft thereto and is adapted to be received in friction fit with a tubular stick.

10. The balloon holder according to claim 7 wherein said slot is radiused at edges thereof at said first open end.

11. The balloon holder according to claim 11 wherein said cup further comprises a shoulder interposed between said first open end and said neck, said shoulder having a larger diameter than said neck and less than said first open end.

* * * * *